US005346134A

United States Patent [19]

Ma et al.

[11] Patent Number: 5,346,134

[45] Date of Patent: Sep. 13, 1994

[54] $CO_2$-ASSISTED SPRAY GUN AND NOZZLE

[75] Inventors: Yamin Ma, Roseville; Richard Grady, Eden Prairie; Robert J. Lind, Robbinsdale; Tera D. McCutcheon, Coon Rapids, all of Minn.

[73] Assignee: Graco Inc., Golden Valley, Minn.

[21] Appl. No.: 69,597

[22] Filed: Jun. 1, 1993

[51] Int. Cl.[5] ..... B05B 1/26

[52] U.S. Cl. ..... 239/288.5; 239/296; 239/526; 239/299

[58] Field of Search ..... 239/290–300, 239/288, 288.3, 288.5, 525, 526, DIG. 14, 429

[56] References Cited

U.S. PATENT DOCUMENTS

| | | | |
|---|---|---|---|
| 820,944 | 9/1959 | Wald | 239/288.5 |
| 3,685,736 | 8/1972 | Diegelman | 239/118 |
| 4,023,524 | 5/1977 | Goldfarb et al. | 222/335 X |
| 5,064,119 | 11/1991 | Mellette . | |
| 5,141,156 | 8/1992 | Hoy et al. | 239/296 X |

FOREIGN PATENT DOCUMENTS

| | | | |
|---|---|---|---|
| 334240 | 1/1956 | Switzerland | 239/228.5 |

*Primary Examiner*—Andres Kashnikow
*Assistant Examiner*—Kevin P. Weldon
*Attorney, Agent, or Firm*—Palmatier, Sjoquist & Helget

[57] ABSTRACT

A liquid-atomizing spray gun having an improved nozzle construction for spraying liquids under predetermined hydraulic pressures, and with the assistance of carbon dioxide gases, wherein the nozzle includes a forwardly-projecting shield having ports directed toward the atomized spray pattern emanating from a spray tip. The nozzle also includes ports for ejecting $CO_2$ gas for assisting in the atomization process, the overall design providing $CO_2$-assisted hydraulic spraying and preventing air entrainment into the atomized particles in the region proximate the spray nozzle.

11 Claims, 2 Drawing Sheets

$CO_2$-ASSISTED SPRAY GUN AND NOZZLE

BACKGROUND OF THE INVENTION

The present invention relates to pneumatically-assisted hydraulic spray guns, particularly for the coating industry. More narrowly, the invention relates to a pneumatically-assisted hydraulic spray gun having improvements for improving the coating finish on particular surfaces, and with respect to particular types of coating materials.

Pneumatically-assisted hydraulic spray guns were first disclosed in U.S. Pat. No. 3,843,052, issued on Oct. 22, 1974, to Cowan. The principles of operation of this new spray gun enabled a significant reduction in the hydraulic liquid pressures previously required for hydraulic spray guns. For example, hydraulic spraying pressures up to the range of about 4,000 pounds per square inch (psi) were required in earlier hydraulic spray guns in order to achieve an adequate quality of atomization wherein the spray gun could be used for spraying fine finishes on smooth surfaces. The invention of the '052 patent enabled the hydraulic pressures for such spraying to be reduced by a factor of two or three, while requiring only a nominal additional air pressure source, in the range of 10–20 psi. When the air pressure source was properly directed, through the use of air jet openings on the spray gun, to impinge slightly ahead of the region of atomization, the vast improvement in atomization quality at lower hydraulic pressures was achieved.

The principles of the '052 patent have been followed in a number of subsequent patents, including patents which have disclosed devices operating at still lower hydraulic pressures, but at increased air pressures, such as U.S. Pat. No. 5,064,119, issued Nov. 12, 1991. This latter patent utilizes the air-assist features to achieve satisfactory atomization for relatively low hydraulic liquid atomization pressures.

Recent advances in the development of coatings for improved finish quality have yielded coating materials which have significantly higher solid content than previously was available. These newer coatings are more difficult to atomize as a result of the increased solid content, and therefore spray guns of the foregoing types have been required to necessarily operate at higher pressures. For such coatings, it is not unusual to require hydraulic pressures in the range of 3,000–4,000 psi, together with the use of air-assistance in the range of 10–30 psi. Furthermore, recent advances have led to the use of new types of solvents in combination with coating materials; particularly, the use of water as a solvent has become popular because of its improved environmental effects. However, water-based coating materials tend to increase the problems noted in the following paragraph, leading to a reduction in quality of the coating finish.

It has been noted that air-assisted hydraulic spray guns do suffer from the problem of providing quality finishes in certain spraying environments. For example, the air-assisted hydraulic spray gun device has not proven to be an adequate solution for producing high quality smooth finishes on woodwork, as for example in the case of the need to produce high quality furniture finishes. The problem appears to be caused by air entrainment into the spray particles, which results in air bubbles being created on the surface of the workpiece, and when the coating on the workpiece dries the air bubbles leave an irregular film surface which is unsatisfactory for quality films on furniture. These dried air bubbles appear as voids in the finish of about 0.4 mil in size, which degrades the finish. This problem is particularly noticeable when water base coatings are applied to wood finishes.

It has been discovered that the replacement of pressurized air to the spray gun with pressurized carbon dioxide ($CO_2$) does tend to eliminate the voids above noted. This is apparently a result of the fact that $CO_2$ is much more soluble in water and other solvents than is air; and therefore the $CO_2$ bubbles which might otherwise occur are absorbed into the film before the film coating dries on the article. However, a problem in using $CO_2$ in such spraying applications is that $CO_2$ is considerably more expensive than pressurized air, and the volumetric quantities required significantly increase the cost of spraying with this gas. Therefore, this solution becomes practical only if the volumetric quantities of $CO_2$ can be significantly reduced in air-assisted hydraulic spraying equipment. A further problem exists in that there may still be some air entrainment into the atomized spray pattern even when $CO_2$ is used as the atomizing agent, because the spray pattern itself creates a certain degree of air turbulence in the zone of atomization immediately in front of the spray nozzle of the spray gun. This zone of turbulence will cause some air entrainment in the atomized particles, wherein the air-entrained particles are still conveyed to the workpiece to produce the voids described hereinbefore. Thus, the use of $CO_2$ as the atomizing agent reduces the surface voids but does not entirely eliminate them, yet suffers from the problem of the heavy cost of consumption of the $CO_2$ gas.

SUMMARY OF THE INVENTION

The present invention comprises an air-assisted hydraulic spray gun having an improved nozzle construction to enable the use of a lesser volume of $CO_2$ as the atomizing agent, and significantly reducing the possibility of air entrainment into the atomized particles in the atomization region immediately in front of the spray nozzle. The nozzle construction includes a forwardly-projecting shield having ports directed toward the atomized spray pattern, supplementing the $CO_2$-assisted atomization ports, thereby requiring a lower total volume of $CO_2$ for satisfactory spraying than is possible in the prior art air-assisted hydraulic spray devices. This shield provides protection against air entrapment into the atomized particles, while not interfering with the cleanliness of the spray tip; i.e., the shield does not result in excessive accumulation of coating material on the spray gun itself and in the region around the spray tip.

It is the principal object of the present invention to provide a $CO_2$-assisted hydraulic spray gun for producing an improved quality of finish on certain products and with certain coating materials.

It is another object and advantage of the present invention to provide a $CO_2$-assisted hydraulic spray gun having significantly reduced air entrainment into the atomized particles.

It is another object and advantage of the present invention to provide a spray gun having a protective shield to significantly reduce the possibility of air entrainment into atomized spray particles immediately adjacent the spray nozzle.

The foregoing and other objects and advantages of the invention will become apparent from the following specification and claims, and with reference to the appended drawings.

DESCRIPTION OF THE PREFERRED EMBODIMENT

Figure 1:
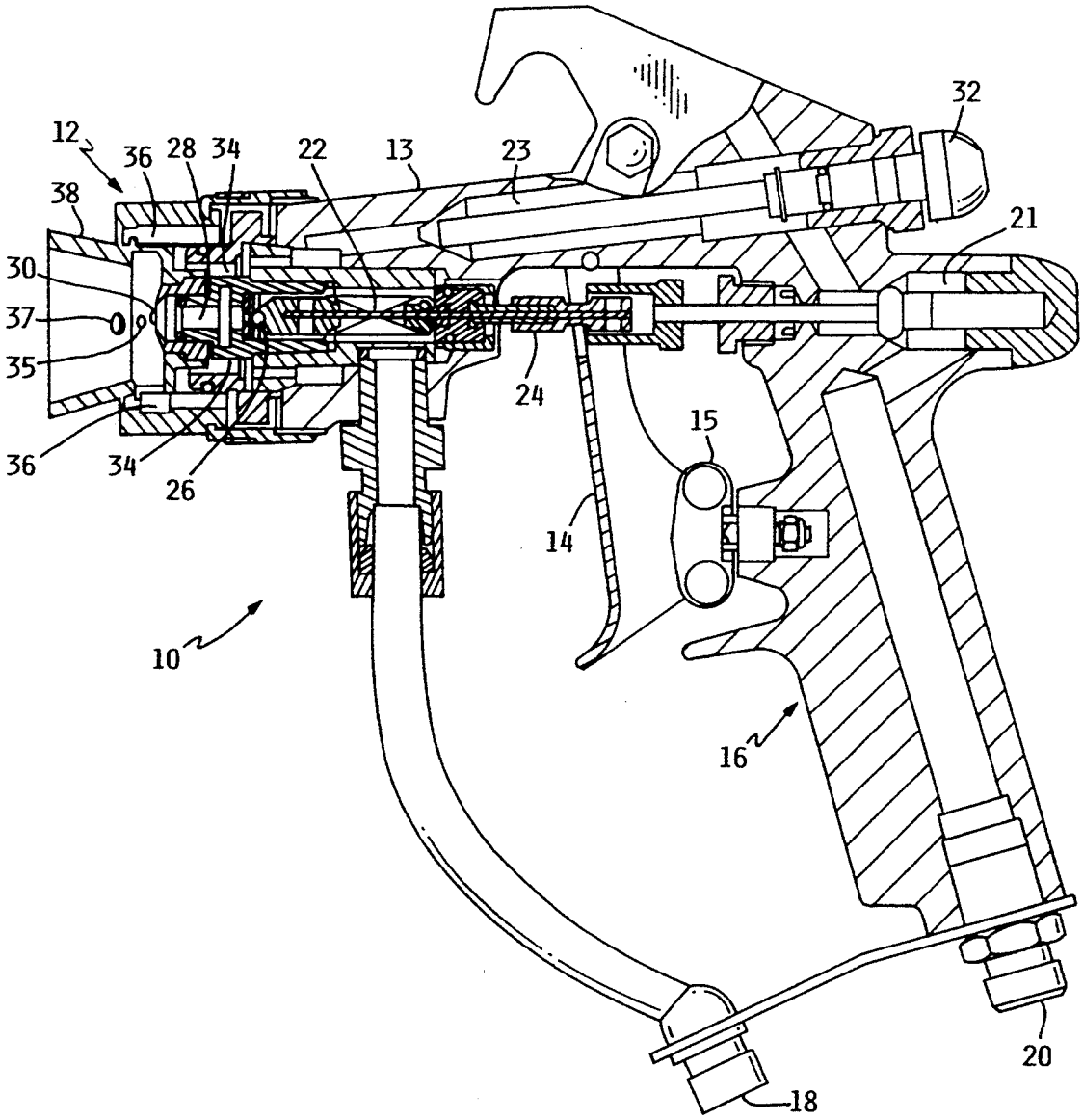
FIG. 1 shows a cross-section elevation view of a spray gun having the invention as a part thereof.

Referring first to FIG. 1 there is shown a spray gun 10 in elevation and partial cross-section view. The spray gun 10 has a nozzle 12 attachable to a gun body 13, and the gun body 13 has a handle 16 and a trigger 14. A trigger safety lever 15 is also affixed to the handle. A liquid inlet 18 is coupled to the body 13, and an air/gas inlet 20 is connected into the handle 16 of the spray gun.

Hydraulically-pressurized liquid enters inlet 18 and essentially fills liquid chamber 22; the pressurized liquid is confined within chamber 22 until trigger 14 is squeezed. When trigger 14 is squeezed a valve actuator 24 moves rearwardly to unseat valve 26 from a liquid emission port. This permits the pressurized liquid in chamber 22 to eject forwardly into a nozzle chamber 28, and from there through an orifice in spray tip 30. At the same time, pressurized air/gas which has been admitted into inlet 20 is permitted to pass from chamber 21 into a chamber 23 and adjustable valve 32 selectively closes the output from chamber 23, thereby regulating the air/gas flow into a plurality of passages in nozzle 12. One set of passages 34 permits the pressurized air/gas to eject forwardly from ports closely adjacent to spray tip 30; another set of passages 36 permit the pressurized air/gas to flow to the front portion of the nozzle and to eject via ports which are forwardly from the front of spray tip 30. An example of two such ports is shown in FIG. 1, as ports 35 and 37. The air/gas emitted from these ports contributes to the quality of atomization and spray pattern shaping as will be hereinafter described. A forwardly-projecting nozzle shroud 38 is affixed to nozzle 12 for purposes which will be hereinafter described.

Figure 3:
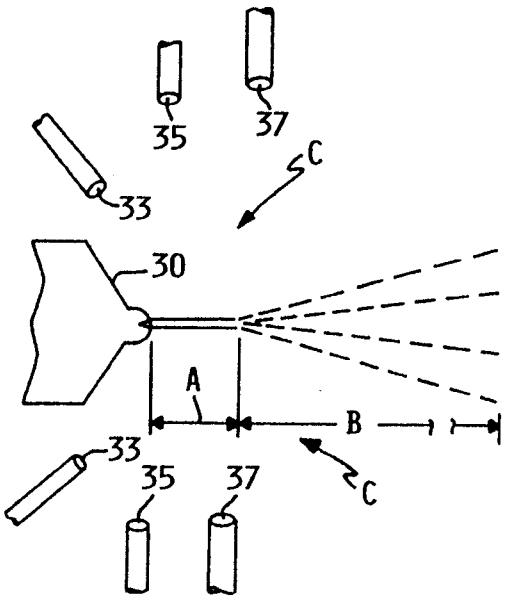
FIG. 3 shows a pictorial diagram illustrating the advantages of the invention.
Figure 2:
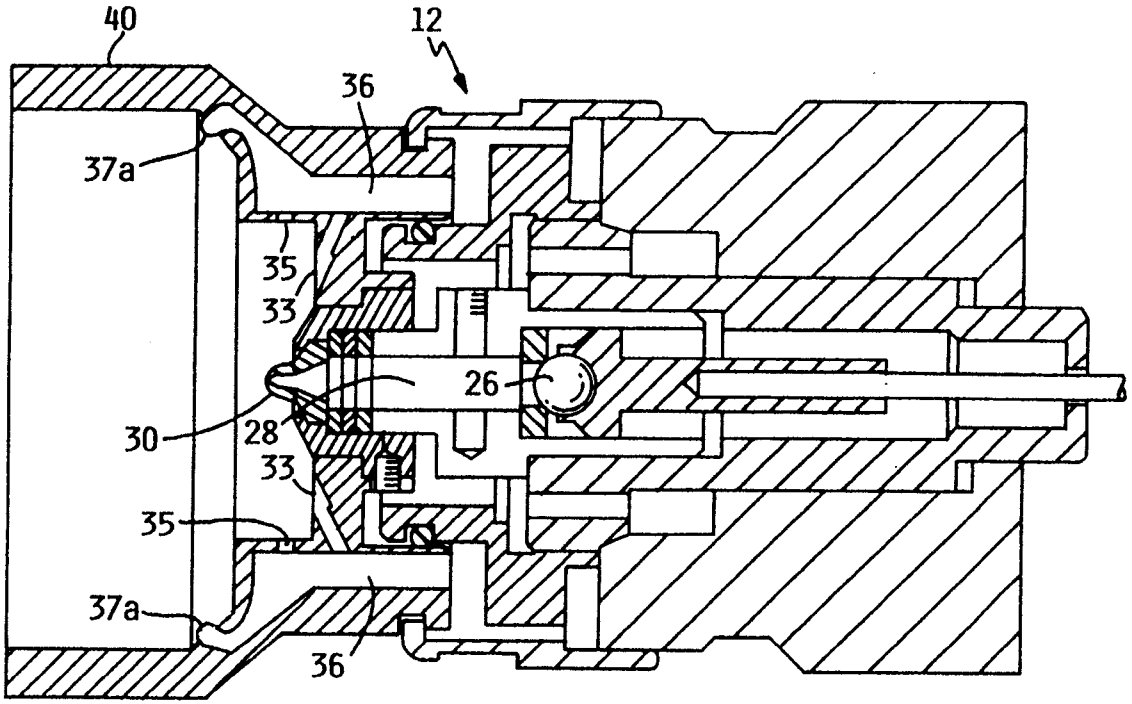
FIG. 2 shows a cross-section view of an alternative form of the invention.

FIG. 2 shows the nozzle 12 portion of spray gun 10 in a horizontal cross-sectional view, with a second embodiment 40 of a nozzle shroud. The cross-sectional view of FIG. 2 shows passages 36 and ports 35 emanating therefrom. Also shown are ports 33 which emanate from passages 36 and open proximate the spray tip 30. The ports 37a are also in flow relation to passages 36, but are positioned slightly differently from the ports 37 shown in FIG. 1. The nozzle shroud 40 extends forwardly of spray tip 30 by a considerable distance, in a manner comparable with the position of nozzle shroud 38 in FIG. 1. The gas which is preferred for use in connection with the present invention is carbon dioxide ($CO_2$). The gas is introduced at inlet 20, and flows through the various passages described hereinbefore, to be emitted from the several ports which are arranged proximate the tip 30 and forwardly of the tip 30. Referring to FIG. 2, the $CO_2$ emitted from ports 33 and 35 assist in the atomization of the pressurized liquid emitted via spray tip 30. The $CO_2$ emitted from ports 37a envelope the atomized spray pattern and prevent air from the surrounding environment from becoming entrained in the liquid particles which form a part of the spray pattern. FIG. 3 diagrammatically illustrates the function of the various ports in relation to the liquid emissions from spray tip 30. The liquid orifice through spray tip 30 is preferably a "cat's eye" orifice having a generally elliptical opening so as to pass liquid in the form of a thin, flat liquid sheet. For reference purposes, the zone immediately forward of spray tip 30 is referred to zone "A," which is the region wherein hydraulically-pressurized liquid is emitted as a fine sheet, in substantially coherent liquid form. The region forwardly of zone "A," is referred to as zone "B," and extends to the article to be coated. In this zone "B," the liquid particles are reduced to atomized form and are conveyed forwardly in the form of a finely-atomized mist. The regions indicated by the arrows and "C" is referred to as the entrainment region, which is the region wherein air may become entrained into the spray particles in zones "A" and "B." The emission of the coherent film of liquid of zone "A," and the forwardly-moving spray of particles in zone "B" causes a certain turbulence to the surrounding air, with an incrementally lower pressure in the air in region "C." This incrementally lower pressure causes air from the surrounding environment to tend to flow toward the spray tip 30, and the air flow patterns therefor created may permit the air entrainment to occur. The diagram of FIG. 3 illustrates how the flow of $CO_2$ through ports 33, 35 and 37 eliminate this problem. The $CO_2$ flow through ports 33 and 35 assist in the atomization of the thin film coherent liquid stream of zone "A" into the atomized particles of zone "B." The $CO_2$ emitted from ports 37 introduce the gas into the area of incrementally-reduced pressure, region "C," thereby blocking the flow of ambient air into this region. Therefore, if entrainment occurs in the region immediately forward of spray tip 30, the entrainment will be of $CO_2$ entrainment into the liquid spray particles. It has been found that $CO_2$ entrainment into the spray particles does not result in the production of voids on the surface of the article being sprayed, for the reason that $CO_2$ is more soluble than air. Particularly, when the liquid emitted via spray tip 30 is a water or water-based coating material, the $CO_2$ gas is very soluble in the water particles, and therefore does not produce the air entrainment consequences which would otherwise be a problem.

In operation, it has been found that the construction of FIGS. 1 and 2 will permit a dramatic reduction in the $CO_2$ gas required for fine-quality spray operation, as compared with prior art spray guns not having this construction- For example, it is not unusual to require 15–20 scfm of air flow, at a delivery pressure of about 10 psi, in the prior art spray guns. By comparison, the present invention reduces the corresponding $CO_2$ consumption to approximately 5 scfm at the same pressure, and also achieves a finer quality finish on the article being sprayed. The invention therefore greatly reduces the cost of $CO_2$ required for a spraying operation, and significantly improves the quality of spray finish resulting therefrom.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A spray gun nozzle for the spraying of atomized liquids with the assistance of pressurized carbon dioxide gas, comprising:

a) a liquid spray orifice positioned along an axis and having means for receiving a source of pressurized liquid;

b) a plurality of first gas jet orifices positioned symmetrically about the axis of said liquid spray orifice, each of said gas jet orifices having means for receiving a source of pressurized carbon dioxide gas;

c) a shield member symmetrically positioned about said axis and extending axially from proximate said liquid spray orifice to a predetermined distance downstream from said liquid spray orifice, said shield member having a downstream opening to permit the passage of atomized liquid particles therethrough, and having a plurality of further gas jet orifices therein, each of said further gas jet orifices being generally directed toward said axis; and d) means for supplying a source of pressurized carbon dioxide gas to said further gas jet orifices;

whereby said carbon dioxide gas emitted from said plurality of further gas jet orifices in said shield member envelopes said atomized liquids and thereby prevents entrainment of air with said atomized liquids.

2. The apparatus of claim 1, wherein said further gas jet orifices are positioned at a farther distance from said axis than said plurality of first gas jet orifices.

3. The apparatus of claim 2, where said further gas jet orifices further comprise passages in said shield member, wherein said passages are inclined downstream toward said axis, whereby pressurized carbon dioxide gas emanating from said passages generally surrounds said axis and the region downstream from said liquid spray orifice.

4. The apparatus of claim 3, further comprising a spray gun body affixed to said nozzle, and passages in said spray gun body for conveying pressurized carbon dioxide gas to said plurality of first gas jet orifices and said further gas jet orifices.

5. The apparatus of claim 4, wherein said further gas jet orifices further comprise a pair of further gas jet orifices respectively positioned at diametrically opposite positions relative to said axis.

6. The apparatus of claim 1, wherein said liquid spray orifice further comprises an elliptical opening aligned along a first transverse axis relative to said axis.

7. The apparatus of claim 6, wherein said plurality of further gas jet orifices are aligned transversely of said first transverse axis, and inclined toward said axis.

8. The apparatus of claim 7, wherein said plurality of further gas jet orifices are positioned at a farther distance from said axis than said plurality of first gas jet orifices.

9. The apparatus of claim 8, where said further gas jet orifices further comprise passages in said shield member, wherein said passages are inclined downstream toward said axis, whereby pressurized carbon dioxide gas emanating from said passages generally surrounds said axis and the region downstream from said liquid spray orifice.

10. The apparatus of claim 9, further comprising a spray gun body affixed to said nozzle, and passages in said spray gun body for conveying pressurized carbon dioxide gas to said plurality of first gas jet orifices and said further gas jet orifices.

11. The apparatus of claim 10, wherein said further gas jet orifices further comprise a pair of further gas jet orifices respectively positioned at diametrically opposite positions relative to said axis.

* * * * *